US011346035B2

(12) United States Patent
Choi et al.

(10) Patent No.: US 11,346,035 B2
(45) Date of Patent: May 31, 2022

(54) WASHING MACHINE

(71) Applicant: SAMSUNG ELECTRONICS CO., LTD., Suwon-si (KR)

(72) Inventors: Young-min Choi, Yongin-si (KR); Tae-kil Kim, Suwon-si (KR); Young-hyun Kim, Suwon-si (KR); Young-jin Um, Suwon-si (KR); Kyu-nam Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 240 days.

(21) Appl. No.: 16/603,489

(22) PCT Filed: Jan. 10, 2018

(86) PCT No.: PCT/KR2018/000473
§ 371 (c)(1),
(2) Date: Oct. 7, 2019

(87) PCT Pub. No.: WO2018/186564
PCT Pub. Date: Oct. 11, 2018

(65) Prior Publication Data

US 2021/0277573 A1 Sep. 9, 2021

(30) Foreign Application Priority Data

Apr. 7, 2017 (KR) ..... 10-2017-0045316

(51) Int. Cl.
*D06F 37/24* (2006.01)
*D06F 23/04* (2006.01)
*D06F 37/30* (2020.01)

(52) U.S. Cl.
CPC ..... *D06F 37/24* (2013.01); *D06F 23/04* (2013.01); *D06F 37/304* (2013.01)

(58) Field of Classification Search
None
See application file for complete search history.

(56) References Cited

U.S. PATENT DOCUMENTS

2002/0166349 A1* 11/2002 Lim ..... D06F 37/40 68/23.7

FOREIGN PATENT DOCUMENTS

CN 102704240 10/2012
JP 3564318 9/2004
(Continued)

OTHER PUBLICATIONS

Espacenet translation KR101740361B1 Washing Machine With a Bi-Directionally Rotatable Tub (Year: 2017).*
(Continued)

*Primary Examiner* — Cristi J Tate-Sims
(74) *Attorney, Agent, or Firm* — Staas & Halsey LLP

(57) ABSTRACT

A washing machine is provided. The washing machine comprises a pulsator rotatably disposed in a rotation tub, a washing shaft rotating in conjunction with the pulsator, and a connecting member which connects the washing shaft and a motor to transmit a driving force of the motor to the washing shaft, wherein the connecting member comprises a first bush coupled to the washing shaft and a second bush coupled to the motor, and the second bush is coupled to the washing shaft to which the first bush is coupled and rotates in engagement with the first bush.

13 Claims, 10 Drawing Sheets

(56) References Cited

FOREIGN PATENT DOCUMENTS

| | | |
|---|---|---|
| KR | 10-0353201 | 9/2002 |
| KR | 10-0400571 | 10/2003 |
| KR | 10-0469256 | 2/2005 |
| KR | 10-2012-0130613 | 12/2012 |
| KR | 10-2016-0035079 | 3/2016 |
| WO | WO 2012/128567 | 9/2012 |

OTHER PUBLICATIONS

International Search Report dated Apr. 19, 2018 in corresponding International Patent Application No. PCT/KR2018/000473.
Written Opinion of the International Searching Authority dated Apr. 19, 2018 in corresponding International Patent Application No. PCT/KR2018/000473.
Korean Office Action dated May 15, 2021 from Korean Application No. 10-2017-0045316, 9 pages.

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2018/000473 filed on Jan. 10, 2018, which claims foreign priority benefit under 35 U.S.C. § 119 of Korean Patent Application No. 10-2017-0045316 filed Apr. 7, 2017, the entire contents of both of which are incorporated herein by reference.

TECHNICAL FIELD

The disclosure relates to a washing machine which is capable of reducing noises that occur during operation.

BACKGROUND ART

A washing machine comprises a water tub accommodating washing water, a rotation tub rotatably disposed in the water tub, a pulsator rotatably disposed in the rotation tub, and a motor for driving the rotation tub and the pulsator.

Laundry introduced into a rotation tub is agitated with washing water by a pulsator and a rotation tub rotating by a driving force of a motor, and pollutants may thereby be removed.

A motor and a pulsator are shaft-coupled by a washing shaft, and the pulsator may rotate by the driving force of the motor. Also, a rotation tub may selectively receive the driving force from the motor through a separate clutch unit. Through this, a washing machine may operate in a washing mode wherein it operates by a rotation of a pulsator and a selective rotation of a rotation tub and in a spin-dry mode wherein a pulsator and a rotation tub rotate together.

In general, a washing shaft is shaft-coupled to a rotor of a motor, and always rotates together with the rotor when the motor operates. Accordingly, a strong fastening force is required in coupling of a washing shaft and a motor.

For this, in the conventional technology, slip and movement of a washing shaft inserted into a rotor were prevented by forming a serration on an outer circumferential surface of the washing shaft, and forming a serration engaged with the serration of the washing shaft on an inner circumferential surface of an insertion opening of the rotor into which the washing shaft is inserted. Also, by fastening the front end of the washing shaft inserted into the rotor with the rotor through a nut or a bolt, separation of the washing shaft from the rotor was prevented.

However, in fastening of a washing shaft and a rotor in the conventional technology, between a serration of a washing shaft and a serration of a rotor, a regular gap in consideration of assemblibity, serviceability, component distribution, or geometric tolerance occurred, and there was a disadvantage that, in case a driving force generated from a motor is big, impact noises due to slip and movement generated in a gap between a washing shaft and a rotor occurred.

DETAILED DESCRIPTION OF THE INVENTION

Technical Problem

The purpose of the disclosure is in providing a washing machine which is capable of reducing noises generated on a fastening part of a washing shaft and a motor during operation by improving a fastening force between a washing shaft and a motor.

Technical Solution

The disclosure for achieving the aforementioned purpose comprises a pulsator rotatably disposed in a rotation tub, a washing shaft rotating in conjunction with the pulsator, and a connecting member which connects the washing shaft and a motor to transmit a driving force of the motor to the washing shaft, wherein the connecting member comprises a first bush coupled to the washing shaft and a second bush coupled to the motor, and the second bush is coupled to the washing shaft to which the first bush is coupled and rotates in engagement with the first bush.

The first bush may comprise a first concave-convex part formed along the circumference of the washing shaft, and the second bush may comprise a second concave-convex part engaged with the first concave-convex part.

The first bush may comprise a first body to which the washing shaft is penetration-coupled and a flange part coupled to the first body, and the second bush may comprise a second body into which the first body is inserted and to which a portion of the washing shaft that penetrated the first body is coupled and a seating part wherein the flange part is seated. The first concave-convex part may be formed in the flange part, and the second concave-convex part may be formed in the seating part.

The flange part may protrude in the radial direction of the washing shaft from the upper end portion of the first body, and the seating part may be formed on the upper surface of the second body.

Each of the first and second bodies may be formed in the form of a cylinder into which the washing shaft can be inserted, and the first concave-convex part may be formed on the bottom surface of the flange part, and the second concave-convex part may be formed in the seating part contacting the bottom surface of the flange part.

The first and second bushes may consist of metallic materials, and the first concave-convex part and the second concave-convex part may be formed through knurling.

Each of the first and second concave-convex parts may comprise several threads and several roots formed along the circumference of the flange part and the circumference of the seating part.

The second body may comprise a first hole into which the first body is inserted and a second hole to which a portion of the washing shaft that is connected with the first hole and penetrated the first body is insertion-coupled.

The washing shaft may comprise a first portion coupled to the first body and a second portion coupled to the second body, and the first and second portions may respectively comprise first and second serration parts formed on an outer circumferential surface.

The first body may comprise a penetration hole to which the first portion is penetration-coupled and a third serration part that is formed on an inner circumferential surface of the penetration hole and is engaged with the first serration part.

The first serration part and the third serration part may be interference fitted.

The second body may comprise a fourth serration part that is formed on an inner circumferential surface of the second hole and is engaged with the second serration part.

The second serration part and the fourth serration part may be clearance fitted.

The motor may comprise a stator and a rotor that rotates by an electromagnetic force with the stator, and the second bush may comprise several protruding portions protruding from the side surface, and may be coupled to a rotation center portion of the rotor.

The washing machine may further comprise a clutch unit which makes a driving force generated at the motor be selectively transmitted to a spin-dry shaft rotating the rotation tub.

In addition, the disclosure for achieving the aforementioned purpose may provide a washing machine comprising a main body, a water tub which is disposed in the main body and accommodates washing water, a rotation tub rotatively disposed in the water tub, a pulsator rotatably disposed in the rotation tub, a washing shaft coupled to the pulsator, a motor exerting a driving force to the washing shaft, a first bush which the washing shaft penetrates and is serration-coupled to and which comprises a flange part wherein a first concave-convex part is formed, and a second bush which comprises a seating part wherein the flange part is seated and a second concave-convex part formed in the seating part and engaged with the first concave-convex part, and to which a portion of the washing shaft that penetrated the first bush is serration-coupled, and which rotates in conjunction with the motor.

BEST MODE FOR IMPLEMENTING THE DISCLOSURE

Figure 1:
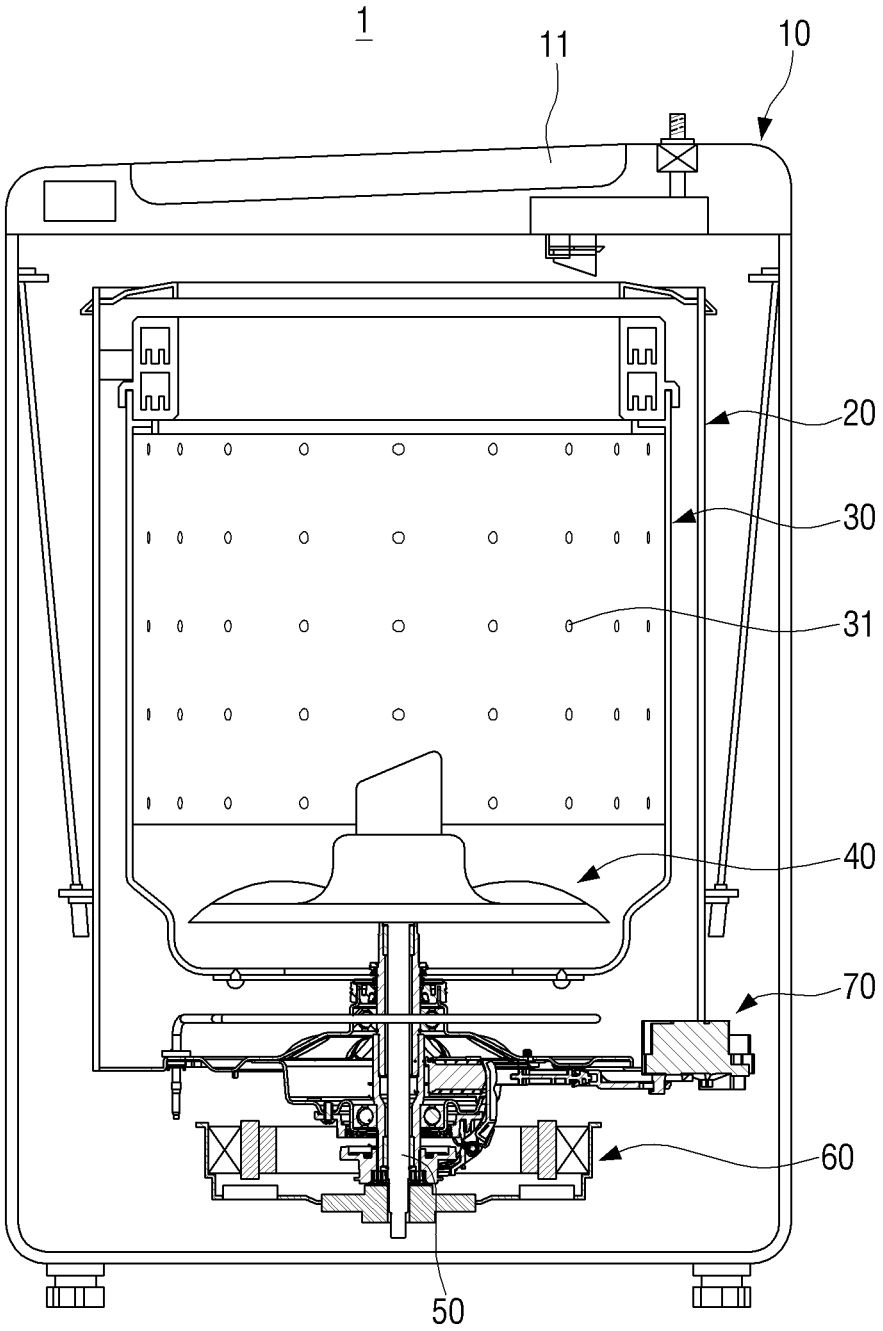
FIG. 1 is a side cross-sectional view illustrating a schematic configuration of a washing machine according to an embodiment of the disclosure.

Hereinafter, various embodiments of the disclosure will be described in detail with reference to the accompanying drawings. Meanwhile, it should be noted that the embodiments described below will be described based on embodiments that are most appropriate for understanding the technical characteristics of the disclosure, and the technical characteristics of the disclosure are not to be limited by the embodiments described below, and the embodiments are just for exemplifying that the disclosure may be implemented as in the embodiments described below.

Accordingly, various modifications of the disclosure may be made within the technical scope of the disclosure through the embodiments described below, and it is intended that the modified embodiments are within the technical scope of the disclosure. Also, with respect to the reference numerals described in the accompany drawings for promoting understanding of the embodiments described below, related components among components performing the same functions in each embodiment were indicated with the same numbers or numbers in line with one another. In addition, in the accompanying drawings, components may not be illustrated in their actual sizes, but some components may be illustrated in more exaggerated sizes than their actual sizes for promoting understanding of the disclosure.

FIG. 1 is a side cross-sectional view illustrating a schematic configuration of a washing machine 1 according to an embodiment of the disclosure.

Referring to FIG. 1, the washing machine 1 comprises a main body 10 forming the exterior, a water tub 20 which is disposed in the main body 10 and accommodates washing water, a rotating tub 30 rotatively disposed in the water tub 20, a pulsator 40 rotatively disposed in the rotation tub 30, a washing shaft 50 coupled to the pulsator 40, a motor 60 which is coupled to the washing shaft 50 and exerts a driving force to the washing shaft 50, and a clutch unit 70 which selectively transmits the driving force generated at the motor 60 to the rotation tub 30.

In the upper part of the main body 10 forming the exterior of the washing machine 1, an inlet for introduction of laundry inside the rotation tub 30 is formed, and on the inlet, a door 11 opening and closing the inlet is disposed.

Washing water is stored in the water tub 20 disposed in the main body 10, and the water tub 20 is supported through a separate suspension apparatus (not shown) in the main body 10, and may thereby reduce vibration generated in the operating process of the washing machine 1.

The rotation tub 30 is rotatively disposed in the water tub 20 in the form of a cylinder which is open to one side, and the rotation tub 30 comprises several through-holes 31 formed on the side surface, and accordingly, washing water may be introduced from the water tub 20 or washing water may be discharged to the water tub 20.

The pulsator 40 is rotatively disposed in the rotation tub 30, and as illustrated in FIG. 1, the pulsator 40 is rotatively disposed on the bottom surface of the rotation tub 30, and may thereby agitate laundry and washing water introduced into the rotation tub 30.

The washing shaft 50 is shaft-coupled to the pulsator 40 and the motor 60, and rotates by a driving force of the motor 60, and to one end of the washing shaft 50, the pulsator 40 is coupled, and on the other end of the washing shaft 50, the motor 60 is coupled, and accordingly, the washing shaft 50 and the pulsator 40 may rotate together by rotation of the motor 60.

The motor 60 is disposed in the lower part of the water tub 20, and may rotate the washing shaft 50 by applying a driving force to the washing shaft 50. The motor 60 may be a BLDC motor. A coupled structure of the washing shaft 50 and the motor 60 will be described later.

The clutch unit 70 selectively transmits a driving force generated at the motor 60 to the rotation tub 30, and may thereby selectively rotate the rotation tub 30.

As a specific example, to the lower part of the rotation tub 30, a spin-dry shaft (not shown) may be coupled, and the washing shaft 50 is rotatively disposed in the spin-dry shaft, and accordingly, the washing shaft 50 and the spin-dry shaft may independently rotate. In addition, the clutch unit 70 separates and couples the spin-dry shaft and the motor 60 through a separate coupling (not shown), and may thereby selectively transmit a rotating force to the spin-dry shaft, and through this, the rotation tub 30 may selectively rotate.

Through the clutch unit 70 described as above, the washing machine 1 may operate in a washing mode wherein laundry and washing water are agitated as the pulsator 40 is rotated, and at the same time, the rotation tub 30 is selectively rotated, and in a spin-dry mode wherein laundry is spin-dried as the pulsator 40 and the rotation tub 30 rotate together. Meanwhile, the clutch unit 70 is identical or similar to the conventional technology, and thus detailed explanation will be omitted.

An embodiment wherein the washing machine 1 illustrated in FIG. 1 has a structure wherein the door 11 is provided in the upper part of the main body 10, and the rotation tub 30 and the pulsator 40 rotate based on a rotation center perpendicular to a horizontal plane by the motor 60 provided in the lower part (e.g., an agitation-type washing machine) was illustrated as an example. However, the washing machine 1 according to an embodiment of the disclosure may have a structure wherein an inlet is formed on the side surface of the main body, and the rotation tub and the pulsator rotate based on a horizontal axis (e.g., a drum-type washing machine).

Figure 2:
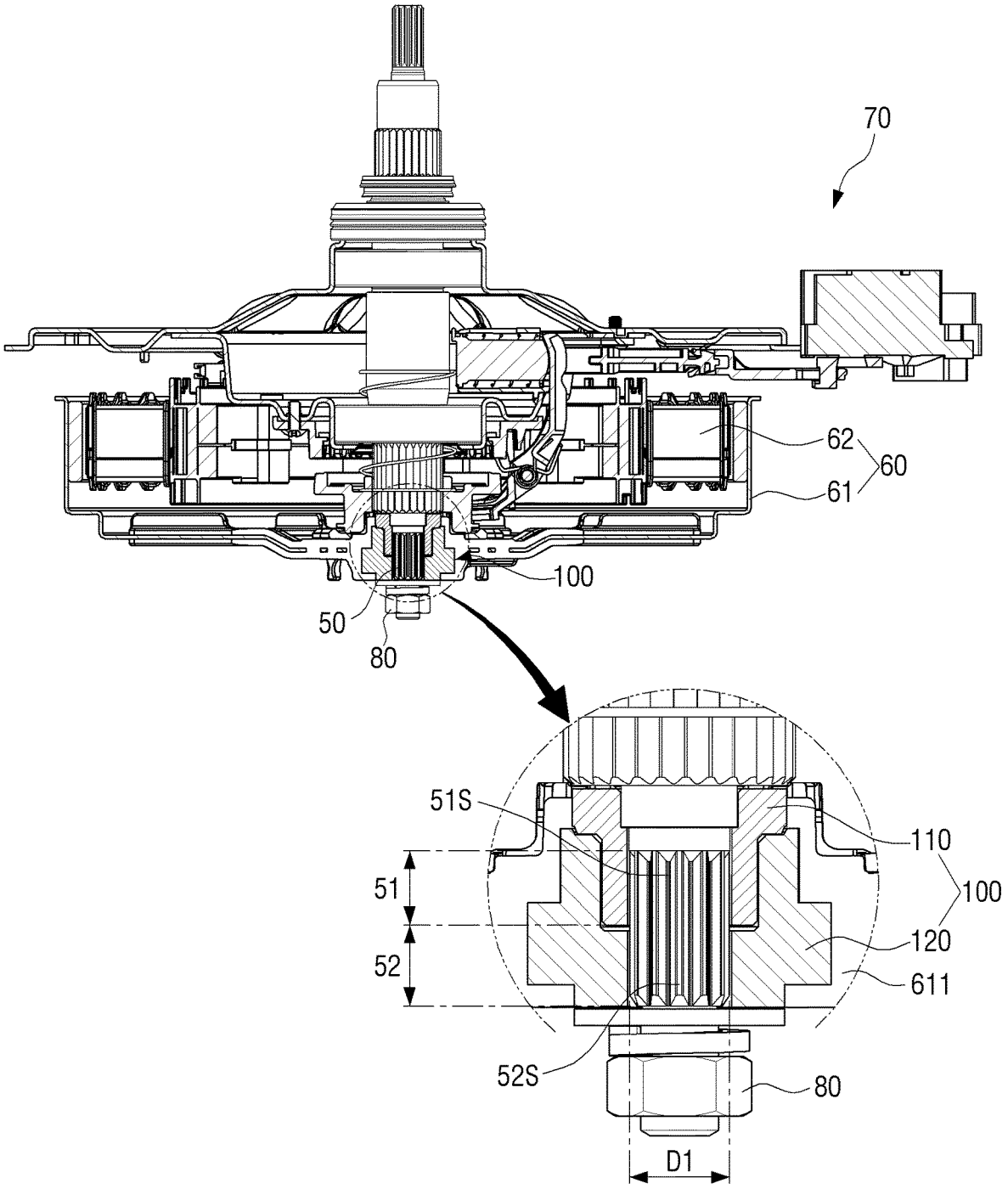
FIG. 2 is an enlarged view illustrating a coupled structure of the washing shaft and the motor illustrated in FIG. 1.

FIG. 2 is an enlarged view illustrating a coupled structure of the washing shaft 50 and the motor 60 illustrated in FIG. 1.

Referring to FIG. 2, the washing shaft 50 and the motor 60 are connected through a connecting member 100, and through this, the connecting member 100 may transmit the driving force of the motor 60 to the washing shaft 50.

The motor 60 comprises a rotor 61 and a stator 62, and the rotor 61 may rotate by an electromagnetic force with the stator 62. The motor 60 may consist of a BLDC motor as described above, and is identical or similar to the conventional technology, and thus detailed explanation will be omitted.

To the rotation center of the rotor 61, the connecting member 100 is coupled, and rotates together with the rotor 61, and to the connecting member 100, the washing shaft 50 is shaft-coupled, and may thereby rotate together with the connecting member 100.

Specifically, in the rotation center of the rotor 61, a hub 611 to which the connecting member 100 is coupled is provided. For example, the hub 611 is an injected object consisting of a plastic material which is coupled to the rotation center of the rotor 61, and to the center part of the hub 611, the connecting member 100 may be coupled through insert-injection.

As illustrated in FIG. 2, the connecting member 100 comprises a first bush 110 and a second bush 120. It is preferable that the first and second bushes 110, 120 transmitting a driving force to the washing shaft 50 consist of a metallic material.

To the first bush 110, the washing shaft 50 is penetration-coupled, and the second bush 120 disposed in the lower part of the first bush 110 is coupled to the hub 611, and may thereby rotate together with the rotor 61. In addition, to the second bush 120, a portion of the washing shaft 50 that penetrated the first bush 110 is insertion-coupled, and the second bush 120 is insertion-coupled to the hub 611, and may thereby be fixed on the rotating rotor 61 stably. Also, the first bush 110 and the second bush 120 are engaged with each other, and accordingly, the rotating force of the second bush 120 may be transmitted to the first bush 110.

The first and second bushes 110, 120 described above may also be referred to as first and second bosses. The detailed structures of the first and second bushes 110, 120 and their coupled structure with the washing shaft 50 and the motor 60 will be described later.

The washing shaft 50 penetrates the second bush 120, and accordingly, the front end of the washing shaft 50 may protrude to the lower side of the second bush 120, and to the protruded front end of the washing shaft 50, a nut 80 is fastened, and may prevent detachment of the washing shaft 50 from the rotor 61.

On the outer circumferential surface of the washing shaft 50 insertion-coupled to the connecting member 100, a serration may be formed, and on the inner circumferential surface of the insertion opening of the connecting member 100 into which the washing shaft 50 is inserted, a serration that is coupled in engagement with the serration of the washing shaft 50 is formed. Through this, the connecting member 100 and the washing shaft 50 may be fastened strongly, and the washing shaft 50 shaft-coupled to the connecting member 100 may rotate together with the connecting member 100 without slip.

Specifically, the washing shaft 50 coupled to the connecting member 100 may comprise a first portion 51 coupled to the first bush 110 and a second portion 52 coupled to the second bush 120. That is, a portion of the washing shaft 50 coupled to the first and second bushes 110, 120 may be distinguished as the first portion 51 and the second portion 52.

On the outer circumferential surface of the first portion 51, a first serration part 51S is formed, and on the outer circumferential surface of the second portion 52, a second serration part 52S is formed.

The first and second serration parts 51S, 52S may consist of several threads and roots, several keys, or several splines formed along the shaft direction of the washing shaft 50 on the outer circumferential surfaces of the first and second portions 51, 52.

The first serration part MS may be coupled to a third serration part (111S in FIG. 3) of the first bush 110, and the second serration part 52S may be coupled to a fourth serration part (121S in FIG. 3) of the second bush 120.

The aforementioned first and second serration parts 51S, 52S are distinguished according to the portions coupled to the first and second bushes 110, 120, and the first serration part MS and the second serration part 52S may be formed integrally on the outer circumferential surface of the washing shaft 50.

Figure 3:
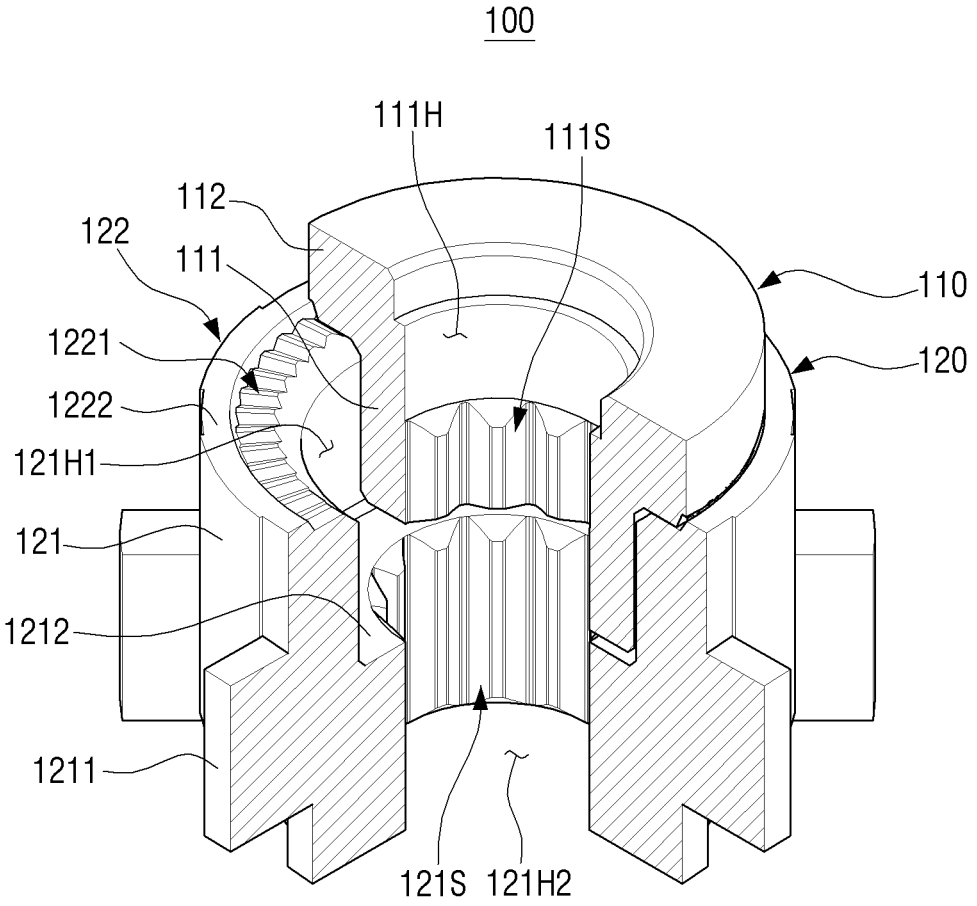
FIG. 3 is a perspective cross-sectional view of the connecting member illustrated in FIG. 2.

FIG. 3 is a perspective cross-sectional view of the connecting member 100 illustrating a coupled configuration of the first bush 110 and the second bush 120 illustrated in FIG. 2. FIGS. 4A to 4D are a perspective view, a plan view, a bottom perspective view, and a bottom view of the first bush 110. FIGS. 5A to 5C are a perspective view, a plan view, and a bottom perspective view of the second bush 120.

Hereinafter, a detailed structure of the connecting member 100 comprising the first and second bushes 110, 120 will be described in detail with reference to FIGS. 3 to 5C.

As illustrated in FIG. 3, the first bush 110 to which the first portion 51 of the washing shaft 50 is penetration-coupled is insertion-coupled to the second bush 120, and the first bush 110 and the second bush 120 are engaged with each other through a first concave-convex part (1121 in FIG. 4C) and a second concave-convex part 1221, and accordingly, the first bush 110 may receive a rotating force from the second bush 120 and rotate together with the second bush 120.

The first concave-convex part 1121 is formed along the circumference of the washing shaft 50 on the first bush 110, and the second concave-convex part 1221 engaged with the first concave-convex part 1121 is formed along the circumference of the washing shaft 50 on the second bush 120. Accordingly, a rotating force in the same direction as the rotating direction of the washing shaft 50 may be transmitted from the second concave-convex part 1221 to the first concave-convex part 1121.

Referring to FIGS. 4A to 4D, the first bush 110 comprises a first body 111 that is coupled to the first portion 51 of the washing shaft 50 as the washing shaft 50 penetrates and a flange part 112 coupled to the first body 111.

The first body 111 is formed in the form of a cylinder into which the washing shaft 50 can be inserted, and the flange part 112 protrudes in the radial direction of the washing shaft 50 from the upper end portion of the first body 111.

Also, the first body 111 comprises a penetration hole 111H formed in the center part such that the washing shaft 50 is penetration-coupled, and to the penetration hole 111H, the first portion 51 of the washing shaft 50 is insertion-coupled.

In addition, the first body 111 comprises a third serration part 111S that is formed on the inner circumferential surface of the penetration hole 111H, and is coupled in engagement with the first serration part 51S formed on the outer circumferential surface of the first portion 51.

Figure 4A:
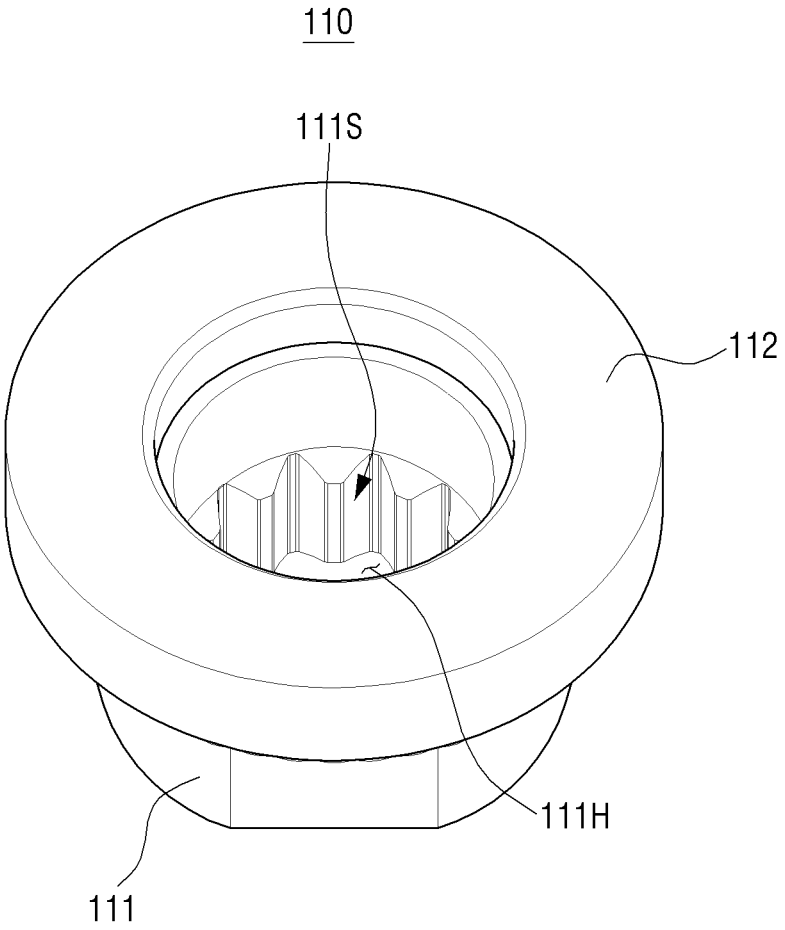
FIG. 4A is a perspective view of the first bush illustrated in FIG. 3.
Figure 4B:
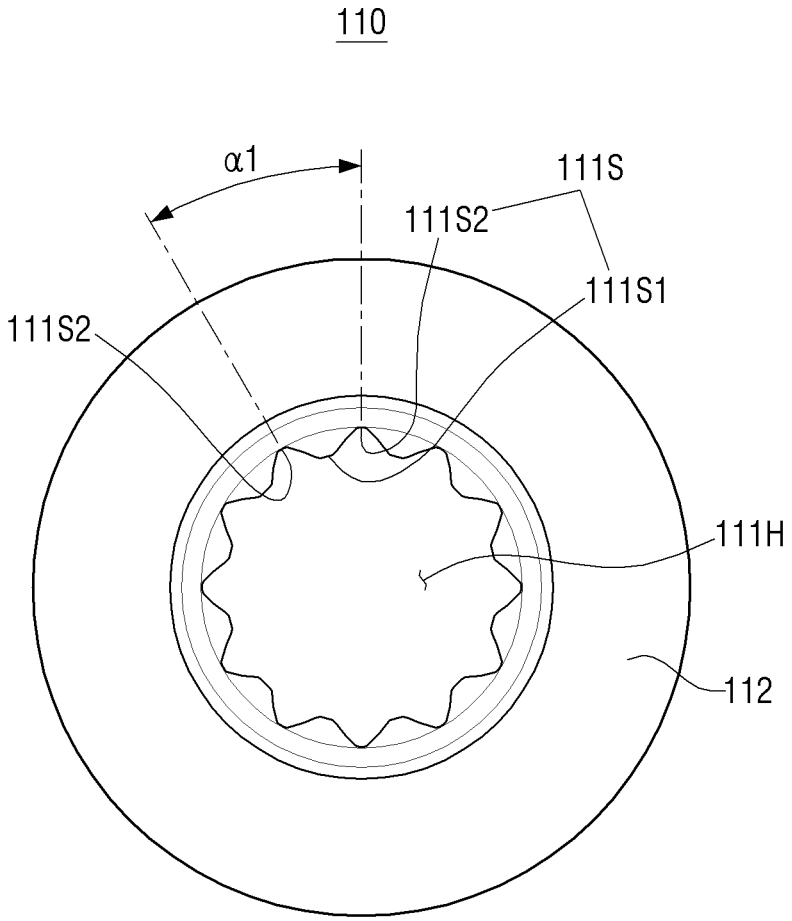
FIG. 4B is a plan view of the first bush illustrated in FIG. 3.
Figure 5A:
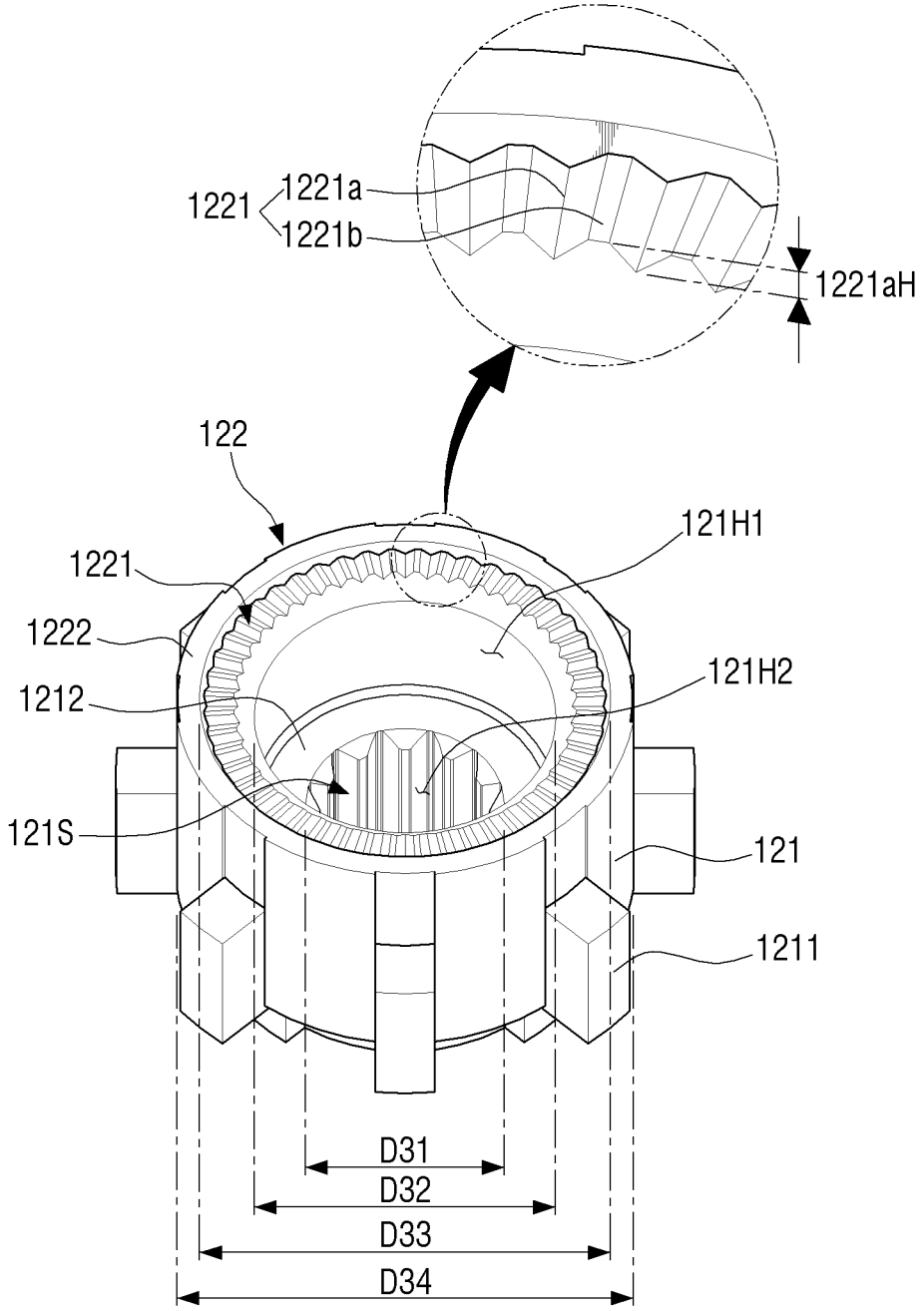
FIG. 5A is a perspective view of the second bush illustrated in FIG. 3.
Figure 5B:
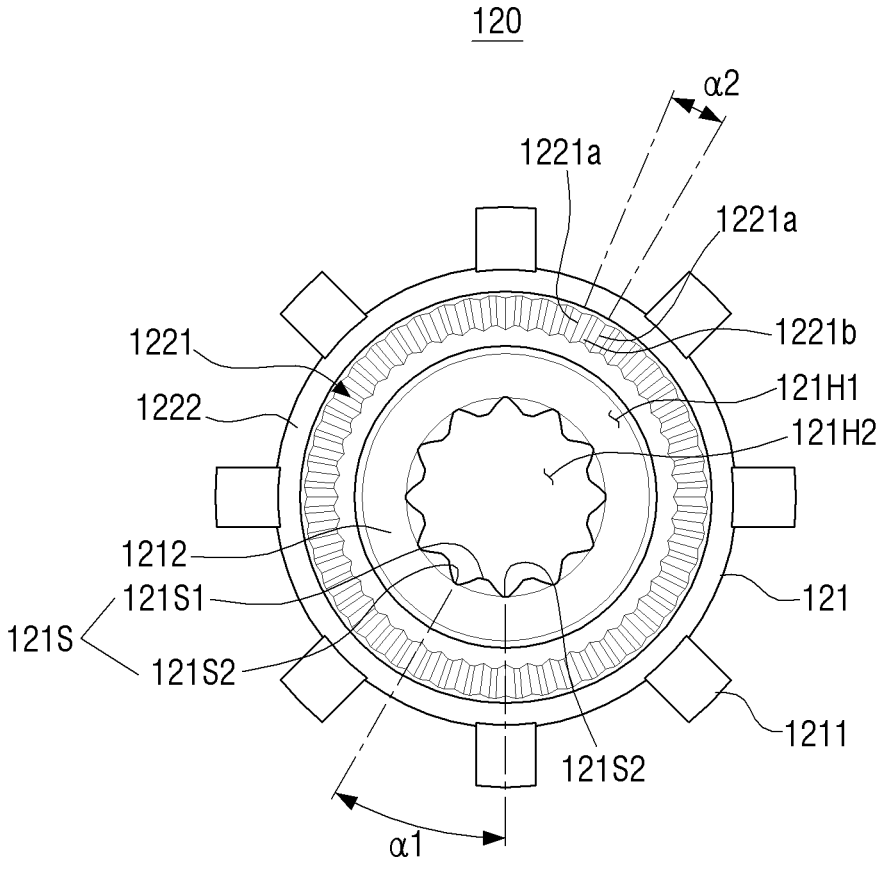
FIG. 5B is a plan view of the second bush illustrated in FIG. 3.
Figure 5C:
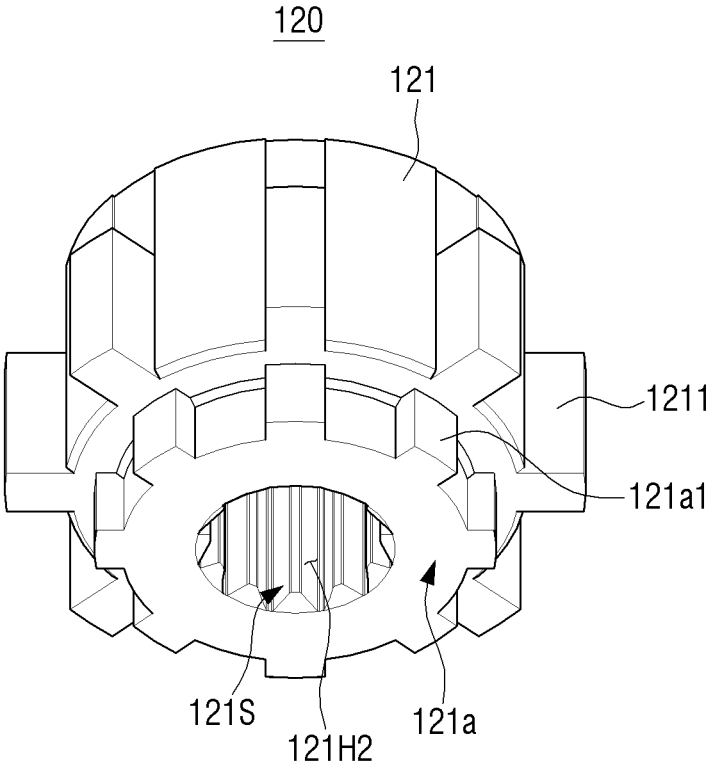
FIG. 5C is a bottom perspective view of the second bush illustrated in FIG. 3.

As illustrated in FIG. 4B, the third serration part 111S comprises several threads 111S1 and several roots 111S2 formed along the longitudinal direction of the penetration hole 111H.

The thread 111S1 and the thread 111S1 adjacent to each other of the third serration part 111S may be disposed at an interval of a first angle α1 based on a rotation center along the inner circumferential surface of the penetration hole 111H, and the root 111S2 and the root 111S2 adjacent to each other may also be disposed at an interval of a first angle α1 along the inner circumferential surface of the penetration hole 111H. For example, the first angle α1 may be 30°, and in this case, the third serration part 111S may consist of twelve threads 111S1 and twelve roots 111S2.

The first serration part M S of the washing shaft 50 is formed in a form corresponding to the third serration part 111S such that it can be coupled in engagement with the third serration part 111S of the first body 111, and comprises several threads and several roots corresponding to the several threads 111S1 and several roots 111S2 of the third serration part 111S. In addition, in the first serration part 51S, a thread and a thread adjacent to each other may also be disposed at a first angle α1 along the outer circumferential surface of the first portion 51, and a root and a root adjacent to each other may also be disposed at a first angle α1 along the outer circumferential surface of the first portion 51.

Also, the diameter (D21 in FIG. 4C) of the penetration hole 111H corresponds to the diameters (D1 in FIG. 2) of the first and second portions 51, 52 of the washing shaft 50. For example, the diameters D1 of the first and second portions 51, 52 in consideration of the first and second serration parts 51S, 52S may consist of a big diameter of 13 mm and a small diameter of 12 mm, and the diameter D21 of the penetration hole 111H wherein the third serration part 111S is formed on the inner circumferential surface may also consist of a big diameter of 13 mm and a small diameter of 12 mm.

In addition, the washing shaft 50 inserted into the penetration hole 111H may be interference fitted to the penetration hole 111H. That is, the first serration part 51S and the third serration part 111S are coupled by interference fitting, and may thereby increase the fastening force between the washing shaft 50 and the first bush 110.

The aforementioned interference fitting means coupling wherein, in coupling the washing shaft 50 to the penetration hole 111H by insertion, the maximum and minimum allowed sizes of the penetration hole 111H are smaller than the maximum and minimum allowed sizes of the washing shaft 50. Specifically, it means coupling wherein the maximum and minimum allowed sizes of the penetration hole 111H are smaller than the maximum and minimum allowed sizes of the first portion 51.

Also, the first portion 51 and the first bush 110 may be coupled not only through interference fitting between the first serration part 51S and the third serration part 111S, but they may also be coupled through welding, etc. after inserting the first portion 51 into the first body 111. Other than the above, a structure wherein the washing shaft 50 and the first bush 110 are integrally formed is also possible.

As described above, the first bush 110 is coupled to the first portion 51 of the washing shaft 50 steadfastly, and accordingly, the first bush 110 and the washing shaft 50 may rotate together without occurrence of slip or movement between the first bush 110 and the washing shaft 50.

Also, a portion of the side surface of the first body 111 may comprise a cut surface 1111 cut along the longitudinal direction of the first body 111. The cut surface 1111 is a component that indicates a standard for matching the directivity of the first bush 110 and the second bush 120 in inserting the first body 111 into the second bush 120.

As described above, the flange part 112 protrudes toward the outside from the upper end portion of the first body 111 in a cylindrical shape, and may be in the form of a circular ring or a cylinder, and as the first body 111 is inserted into the second bush 120, the flange part 112 may be seated on the second bush 120.

Figure 4C:
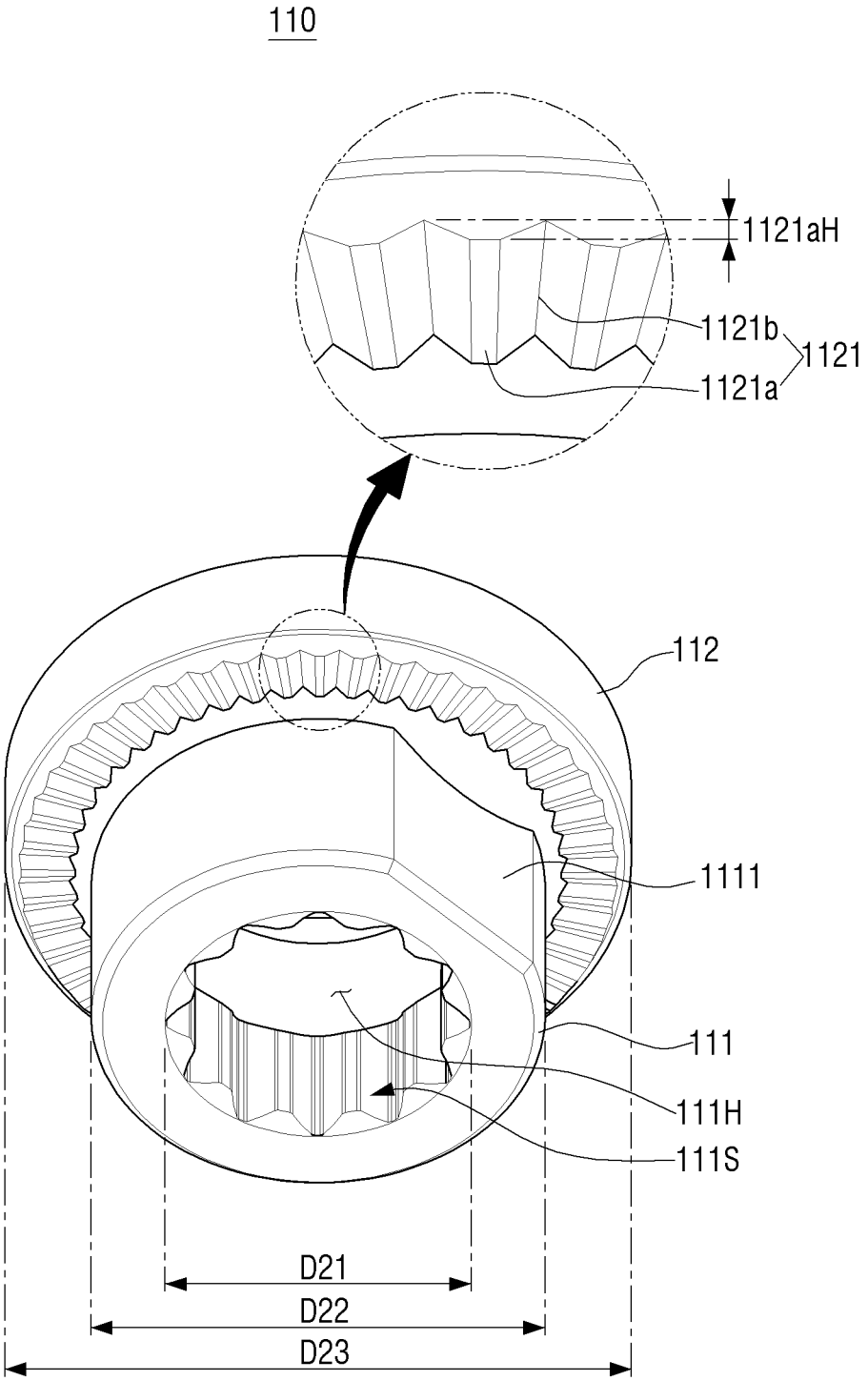
FIG. 4C is a bottom perspective view of the first bush illustrated in FIG. 3.
Figure 4D:
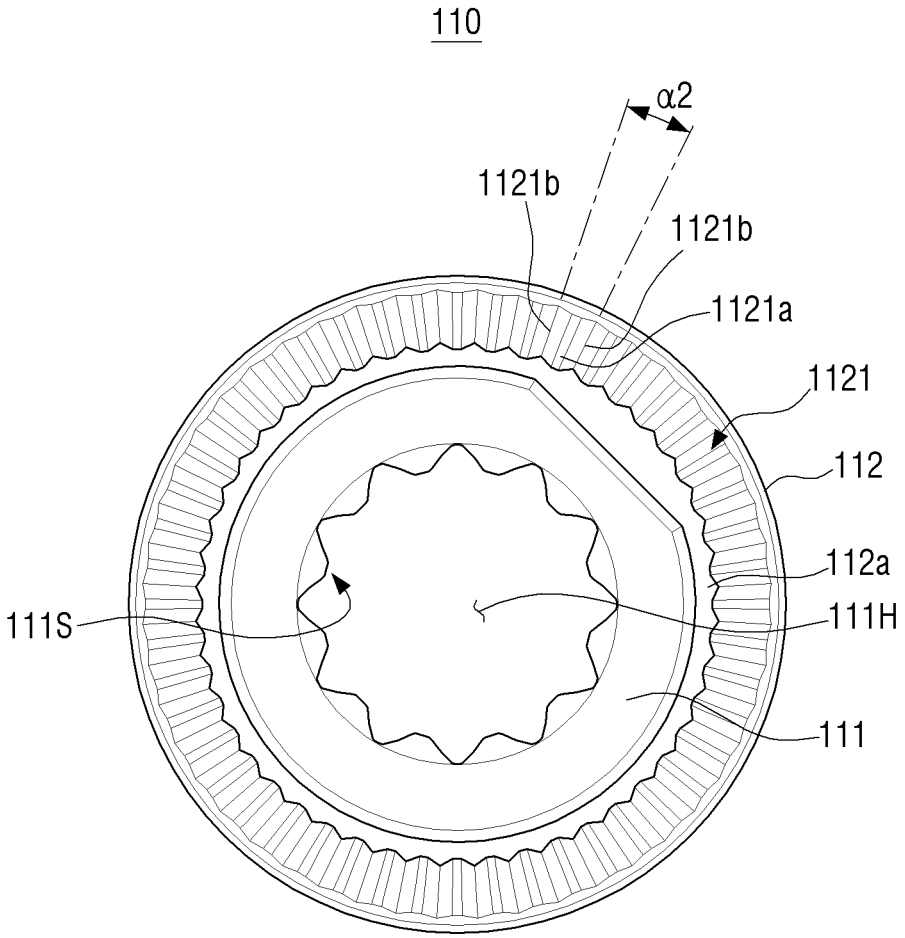
FIG. 4D is a bottom view of the first bush illustrated in FIG. 3.

As illustrated in FIGS. 4C and 4D, on the bottom surface 112*a* of the flange part 112, a first concave-convex part 1121 is formed.

The first concave-convex part 1121 is fastened as it contacts and gets engaged with the second concave-convex part 1221 of the second bush 120. Through this, the second bush 120 that rotates while being coupled to the rotor 61 may directly transmit a rotating force to the first bush 110.

The first concave-convex part 1121 comprises several threads 1121*a* and several roots 1121*b* formed along the circumference of the flange part 112 on the bottom surface 112*a* of the flange part 112. The thread 1121*a* and the thread 1121*a* adjacent to each other may be disposed at an interval of a second angle α2 based on a rotation center along the bottom surface 112*a* of the flange part 112, and the root 1121*b* and the root 1121*b* adjacent to each other may also be disposed at an interval of a second angle α2 based on a rotation center along the bottom surface 112*a* of the flange part 112. For example, the second angle α2 may be 7.5°, and in this case, the first concave-convex part 1121 may consist of forty eight threads 1121*a* and forty eight roots 1121*b*.

In addition, the second concave-convex part 1221 that is engaged with the first concave-convex part 1121 comprises several threads 1221*a* and several roots 1221*b* that are engaged with the several threads 1121*a* and several roots 1121*b* of the first concave-convex part 1121, and through this, the first bush 110 and the second bush 120 may be fastened steadfastly.

The coupled structure of the first bush 110 and the second bush 120 will be described later.

Referring to FIGS. 5A to 5C, the second bush 120 comprises a second body 121 into which the first body 111 is inserted and to which a portion of the washing shaft 50 that penetrated the first body 111 is coupled, and a seating part 122 wherein the flange part 112 is seated.

The second body 121 is formed in the form of a cylinder into which the first body 111 and the washing shaft 50 can be inserted.

The second bush 120 is coupled to the rotation center portion of the rotor 61, and thereby rotates together with the rotor 61, and the second body 121 further comprises several protruding portions 1211 that protrude from the side surface, and may thereby be coupled to the rotating rotor 61 steadfastly. For example, coupling between the second bush 120 and the rotor 61 may consist of spline coupling or serration coupling.

As described above, in the rotation center portion of the rotor 61, a hub 611 may be provided, and the second body 121 wherein several protruding portions 1211 are formed on the side surface may be coupled to the hub 611 through insert injection. Also, as illustrated in FIG. 5C, the second body 121 comprises a step part 121*a* formed in the lower end portion, and comprises several auxiliary protruding portions 121*a*1 formed on the side surface of the step part 121*a*, and may thereby be coupled to the hub 611 more steadfastly.

As illustrated in FIGS. 3, 5A, and 5B, the seating part 122 is formed on the upper surface of the second body 121, and when the first body 111 is inserted into the second bush 120, the flange part 112 may be seated on the seating part 122, and the bottom surface 112*a* of the flange part 112 and the seating part 122 come in contact with each other.

The second body 121 comprises a first hole 121H1 into which the first body 111 is inserted and a second hole 121H2 which is connected with the first hole 121H1 and to which a portion of the washing shaft 50 that penetrated the first body 111 is insertion-coupled.

The diameter D32 of the first hole 121H1 may correspond to the external diameter (D22 in FIG. 4C) of the first body 111, and for example, the external diameter D22 of the first body 111 may consist of 20 mm±0.05 mm, and the diameter D32 of the first hole 121H1 into which the first body 111 is inserted may consist of 20.3 mm±0.1 mm.

The diameter D32 of the first hole 121H1 is constituted to be bigger than the diameter D31 of the second hole 121H2. Accordingly, a supporting part 1212 that can support the first body 111 is formed between the first hole 121H1 and the second hole 121H2. The first body 111 inserted into the first hole 121H1 is seated on the supporting part 1212, and may be supported by the supporting part 1212.

In addition, the height (depth) of the first hole 121H1 corresponds to the height of the first body 111, and when the first body 111 is inserted into the first hole 121H1, the flange part 112 may be seated in contact on the seating part 122.

The second body 121 comprises a fourth serration part 121S that is formed on the inner circumferential surface of the second hole 121H2, and is coupled in engagement with the second serration part 52S formed on the outer circumferential surface of the second part 52.

As illustrated in FIG. 5B, the fourth serration part 121S comprises several threads 121S1 and several roots 121S2 formed alternatingly along the longitudinal direction of the second hole 121H2.

The thread 121S1 and the thread 121S1 adjacent to each other of the fourth serration part 121S may be disposed at an interval of a first angle α1 based on a rotation center along the inner circumferential surface of the second hole 121H2, and the root 121S2 and the root 121S2 adjacent to each other may also be disposed at an interval of a first angle α1 along the inner circumferential surface of the second hole 121H2. For example, the first angle α1 may be 30°, and in this case, the fourth serration part 121S may consist of twelve threads 121S1 and twelve roots 121S2.

The second serration part 52S of the washing shaft 50 is formed in a form corresponding to the fourth serration part 121S such that it can be coupled in engagement with the fourth serration part 121S of the second body 121, and comprises several threads and several roots corresponding to the several threads 121S1 and several roots 121S2 of the fourth serration part 121S. In addition, in the second serration part 52S, a thread and a thread adjacent to each other may also be disposed at a first angle α1 along the outer circumferential surface of the second portion 52, and a root and a root adjacent to each other may also be disposed at a first angle α1 along the outer circumferential surface of the second portion 52.

Accordingly, the diameter D31 of the second hole 121H2 may correspond to the diameter D1 of the second portion 52. For example, the diameter D31 of the second hole 121H2 wherein the fourth serration part 121S is formed on the inner circumferential surface may consist of a big diameter of 13 mm and a small diameter of 12 mm corresponding to the diameter D21 of the penetration hole 111H, and the diameters D1 of the first and second portions 51, 52.

In addition, as described above, the first serration part 51S and the second serration part 52S of the washing shaft 50 have the same structures and may be formed integrally. Accordingly, the structure of the third serration part 111S and the structure of the fourth serration part 121S to which each of the first and second serration parts 51S, 52S is coupled may be the same.

Also, the washing shaft 50 inserted into the second hole 121H2 may be clearance fitted to the second hole 121H2. That is, the second serration part 52S and the fourth serration part 121S are coupled by clearance fitting, and accordingly, the rotating force of the second bush 120 that rotates while being coupled to the rotor 61 may be directly transmitted to the second portion 52 of the washing shaft 50, and at the same time, transmitted to the first portion 51 of the washing shaft 50 clearance fitted to the first bush 110 through the first concave-convex part 1121 engaged with the second concave-convex part 1221.

The aforementioned clearance fitting means coupling wherein, in insert coupling the second portion 52 of the washing shaft 50 to the second hole 121H2, the minimum allowed size of the second hole 121H2 is the same as or bigger than the maximum allowed size of the washing shaft 50, and specifically, means coupling wherein the minimum allowed size of the second hole 121H2 is the same as or bigger than the maximum allowed size of the second portion 52.

As illustrated in FIGS. 3, 5A and 5B, on the upper surface of the second body 121, a seating part 122 wherein the flange part 112 can be seated is formed.

In the seating part 122, a second concave-convex part 1221 that is coupled in engagement with the first concave-convex part 1121 is formed.

In addition, the seating part 122 may further comprise a seating wall 1222 enclosing a portion of the side surface of the flange part 112 such that the flange part 112 can be seated stably.

The seating wall 1222 may be in a form wherein a portion of the upper surface of the second body 121 protrudes to the upper side along the outer circumference of the second concave-convex part 1221, and through this, the side surface of the flange part 112 may be supported by the inner circumferential surface of the seating wall 1222.

For the flange part 112 to be seated in the seating part 122, it is preferable that the external diameter (D23 in FIG. 4C) of the flange part 112 is constituted to be bigger than the diameter D32 of the first hole 121H1, and smaller than the external diameter D33 of the second concave-convex part 1221 [the internal diameter D33 of the seating wall 1222].

As a specific example, the external diameter D23 of the flange part 112 may consist of 27.6 mm±0.1 mm, and the external diameter D33 of the second concave-convex part 1221 may consist of 27.7 mm±0.1 mm, and the external diameter D34 of the second body 121 may consist of 31.0 mm±0.1 mm.

As the flange part 112 is seated in contact on the seating part 122, the first concave-convex part 1121 formed on the bottom surface 112*a* of the flange part 112 and the second concave-convex part 1221 formed in the seating part 122 may be engaged in contact with each other.

For this, the structure of the second concave-convex part 1221 may correspond to the structure of the first concave-convex part 1121 such that it is fastened in engagement with the first concave-convex part 1121. Accordingly, the second concave-convex part 1221 comprises several threads 1221*a* and several roots 1221*b* formed along the circumference of the seating part 122. The thread 1221*a* and the thread 1221*a* adjacent to each other may be disposed at an interval of a second angle α2 based on a rotation center along the seating part 122, and the root 1221*b* and the root 1221*b* adjacent to each other may also be disposed at an interval of a second angle α2 based on a rotation center along the seating part 122. For example, as described above, in case the second angle α2 is 7.5°, the second concave-convex part 1221 may consist of forty eight threads 1221*a* and forty eight roots 1221*b* consisting of forms corresponding to the forty eight threads 1121*a* and forty eight roots 1121*b* of the first concave-convex part 1121.

Also, as a specific example, the heights 1121*a*H of the several threads 1121*a* of the first concave-convex part 1121 may consist of 0.15 mm±0.03 mm, and the heights 1221*a*H of the several threads 1221*a* of the second concave-convex part 1221 corresponding thereto may also consist of 0.15 mm±0.03 mm.

As described above, the first and second concave-convex parts 1121, 1221 which are in contact with each other comprise several threads and roots that are engaged with one another, and may thereby increase a frictional force between the flange part 112 and the seating part 122, and increase a fastening force between the flange part 112 and the seating part 122 when the rotor 61 rotates.

In addition, the first and second concave-convex parts 1121, 1221 may be formed through knurling, and other than this, the first and second concave-convex parts 1121, 1221 may be modified in various forms which can transmit a rotating force by increasing a frictional force between the flange part 112 and the seating part 122.

For example, the forms of the several threads and roots constituting the first and second concave-convex parts 1121, 1221 may have directivity according to the main rotating direction of the rotor 61 in a washing process of the washing machine 1. As a specific example, in case the rotor 61 mainly rotates in one direction, for example, in a clockwise direction in the washing mode and the spin-dry mode of the washing machine 1, the first and second concave-convex parts may be constituted in the form of a buttress thread. In this case, the forms of the several threads of the second concave-convex part 1221 transmitting a force to the first concave-convex part 1121 may be deflected in the same clockwise direction as the main rotating direction of the motor 60.

Accordingly, the rotating force of the second bush 120 rotating in the main rotating direction together with the rotor 61 is transmitted to the second portion 52 through the second serration part 52S of the washing shaft 50 coupled to the fourth serration part 121S, and at the same time, some of the rotating force of the second bush 120 is transmitted to the flange part 112 through the seating part 122, and may be transmitted more easily to the first portion 51 of the washing shaft 50 coupled to the first bush 110 through interference fitting.

As described above, the connecting member 100 according to an embodiment of the disclosure makes the flange part 112 wherein the first concave-convex part 1121 is formed seated in the seating part 122 wherein the second concave-convex part 1221 is formed, and may thereby increase the radius of the seat surface, and through this, increase the slip limit torque between the washing shaft 50 and the connecting member 100.

That is, the external diameters D23, D33 of the flange part 112 and the seating part 122 which transmit rotating forces by being engaged with each other through the first and second concave-convex parts 1121, 1221 are constituted to be bigger than the diameters D1 of the first and second portions 51, 52 which are serration-coupled to the first and second bodies 111, 121. Accordingly, an effect that, even if the diameter of the washing shaft 50 is not increased, the radius of the seat surface in shaft coupling is increased can be derived, and through this, the fastening force between the washing shaft 50 and the connecting member 100 and the fastening force between the washing shaft 50 and the rotor 61 can be increased.

Accordingly, even if a driving force generated from the motor 60 in an operating process of the washing machine 1 becomes bigger, slip and movement between the washing shaft 50 and the connecting member 100 can be prevented, and thus impact noises resulting therefrom can be reduced.

In addition, as the fastening force between the washing shaft 50 and the motor 60 is increased through the aforementioned connecting member 100, washing performance can be increased by applying a motor having a higher output compared to conventional motors to the washing machine 1.

While the various embodiments of the disclosure have been described separately from one another, each embodiment does not have to be implemented independently, but the configuration and operation of each embodiment may be implemented in combination with at least one other embodiment.

Also, while preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A washing machine comprising:

a pulsator rotatably disposed in a rotation tub;

a washing shaft rotating in conjunction with the pulsator; and a connecting member which connects the washing shaft and a motor to transmit a driving force of the motor to the washing shaft, wherein the connecting member comprises a first bush coupled to the washing shaft and a second bush coupled to the motor, and the second bush is coupled to the washing shaft to which the first bush is coupled and rotates in engagement with the first bush, wherein the first bush comprises:

a first body to which the washing shaft is penetration-coupled;

a flange part coupled to the first body; and a first concave-convex part formed on a bottom surface of the washing shaft, and wherein the second bush comprises:

a second body into which the first body is inserted and to which a portion of the washing shaft that penetrates the first body is coupled;

a seating part wherein the flange part is seated; and a second concave-convex part engaged with the first concave-convex part.

2. The washing machine of claim 1, wherein the flange part protrudes in the radial direction of the washing shaft from the upper end portion of the first body, and the seating part is formed on the upper surface of the second body.

3. The washing machine of claim 2, wherein each of the first and second bodies is formed in the form of a cylinder into which the washing shaft can be inserted.

4. The washing machine of claim 3, wherein the first and second bushes consist of metallic materials, and the first concave-convex part and the second concave-convex part are formed through knurling.

5. The washing machine of claim 3, wherein each of the first and second concave-convex parts comprises plurality of threads and plurality of roots formed along the circumference of the flange part and the circumference of the seating part.

6. The washing machine of claim 1, wherein the second body comprises a first hole into which the first body is inserted and a second hole to which a portion of the washing shaft that is connected with the first hole and penetrated the first body is insertion-coupled.

7. The washing machine of claim 6, wherein the washing shaft comprises a first portion coupled to the first body and a second portion coupled to the second body, and the first and second portions respectively comprise first and second serration parts formed on an outer circumferential surface.

8. The washing machine of claim 7, wherein the first body comprises a penetration hole to which the first portion is penetration-coupled and a third serration part that is formed on an inner circumferential surface of the penetration hole and is engaged with the first serration part.

9. The washing machine of claim 8, wherein the first serration part and the third serration part are interference fitted.

10. The washing machine of claim 7, wherein the second body comprises a fourth serration part that is formed on an inner circumferential surface of the second hole and is engaged with the second serration part.

11. The washing machine of claim 10, wherein the second serration part and the fourth serration part are clearance fitted.

12. The washing machine of claim 1, wherein the motor comprises a stator and a rotor that rotates by an electromagnetic force with the stator, and the second bush comprises plurality of protruding portions protruding from a side surface of the second bush, and coupled to a rotation center portion of the rotor.

13. The washing machine of claim 1, further comprising:

a clutch unit which makes a driving force generated at the motor be selectively transmitted to a spin-dry shaft rotating the rotation tub.

* * * * *